US008376190B2

(12) United States Patent
Choi et al.

(10) Patent No.: US 8,376,190 B2
(45) Date of Patent: Feb. 19, 2013

(54) FOAM PUMP DISPENSER HAVING LEAKAGE PREVENTION FUNCTION AGAINST REVERSE FLOW

(76) Inventors: Hee Jin Choi, Seoul (KR); Yu Kwang Oh, Seoul (KR); Won hee Lee, Seoul (KR)

( * ) Notice: Subject to any disclaimer, the term of this patent is extended or adjusted under 35 U.S.C. 154(b) by 702 days.

(21) Appl. No.: 12/098,140

(22) Filed: Apr. 4, 2008

(65) Prior Publication Data

US 2008/0251540 A1 Oct. 16, 2008

(30) Foreign Application Priority Data

Apr. 10, 2007 (KR) ..... 10-2007-0034965

Feb. 14, 2008 (KR) ..... 10-2008-0013394

(51) Int. Cl.
*B67D 7/76* (2010.01)

(52) U.S. Cl. ..... 222/190; 222/135; 222/321.3; 222/321.9; 222/385

(58) Field of Classification Search ..... 222/190, 222/321.3, 321.7–321.9, 135–137, 145.5, 222/340, 341, 383.3, 385, 401, 402.1; 239/432, 239/333

See application file for complete search history.

(56) References Cited

U.S. PATENT DOCUMENTS 5,443,569 A * 8/1995 Uehira et al. ..... 222/190
2005/0029302 A1* 2/2005 Iizuka et al. ..... 222/190
2009/0008412 A1* 1/2009 Choi et al. ..... 222/190

* cited by examiner

*Primary Examiner* — J. Casimer Jacyna
(74) *Attorney, Agent, or Firm* — John K. Park; Park Law Firm

(57) ABSTRACT

A foam pump dispenser that has a prevention function against any reverse flow is disclosed, which comprises an air guide which is engaged at a lower side of the air and liquid mixing chamber of the piston cover member; a liquid leakage prevention spring which is located between the piston cover member and the piston member; and a liquid leakage prevention valve which is covered on the upper side of the liquid compression piston. The foam pump dispenser with the above construction is able to prevent a leakage of liquid, and is able to obtain a reliable fixed supply of air in a pump dispenser designed to properly mix liquid such as foaming cleanser, foam hand soap, shave foam, and hair mousse, etc. with air and to pump out in a foam shape.

11 Claims, 11 Drawing Sheets

FOAM PUMP DISPENSER HAVING LEAKAGE PREVENTION FUNCTION AGAINST REVERSE FLOW

TECHNICAL FIELD

The present invention relates to a foam pump dispenser having a leakage prevention function against a reverse flow, and in particular to a foam pump dispenser having a leakage prevention function against a reverse flow which is able to resolve a problem that liquid flows in a reverse direction for thereby obtaining a fixed flow amount of air in a pump dispenser in which liquid and air like a foaming cleanser, foam hand soap, hair mousse, etc. are mixed and discharged in a foam state.

BACKGROUND ART

Among various foam discharge pump dispensers, there is already a foam dispensing pump container which has the U.S. Pat. No. 5,443,569. The above foam discharge container has (1) a structure that liquid of an air and liquid mixing chamber can flow into an air chamber in a reverse direction, and (2) an air valve for controlling an input and output of air is made of a very thin plastic ejection resin, so that it transforms when a certain impact is applied or a pressure is applied as an external force is applied in the course of an assembling work. (3) Noise (plosive sound) occurs as the air valve comes in contact with the air in the course of pumping. (4) Since a return spring is provided in the liquid cylinder, it is in contact with liquid, so that liquid may change due to corrosion of the metallic spring.

The problems encountered in the above conventional art will be described in more detail. Liquid sucked into the interior of a liquid piston is inputted into an air and liquid mixing chamber. When it is discharged in a mixed state with air, a reverse flow into an air chamber by means of the pressure of air inputted from the air chamber is prevented. However, when a nozzle head moves up or stops, a small amount of liquid filled in the interior of the air and liquid mixing chamber often flow in a reverse direction into the air chamber via along an air inlet passage. As the above reverse flow phenomenon frequently occurs, a relatively lot of liquid is gathered in the air chamber, so that the volume of the air chamber reduces. The air charging amount may decreases due to the reduced volume in the air chamber, so that a mixing ratio of air and liquid supplied into the air and liquid mixing chamber becomes unreliable. Therefore, it is impossible to obtain uniform foams. In worse case, the liquid may be directly discharged without foam. When the liquid exists in the air chamber for a long period of time, the sealing function of the air piston decreases due to a solidification phenomenon to occur within the chamber. In further worse case, the air piston may not properly work.

DISCLOSURE OF THE INVENTION

Accordingly, it is the object of the present invention to provide a foam pump dispenser that has a prevention function against any reverse flow when the nozzle head is pressed so as to discharge foams, a piston cover, which is engaged at a lower side of a nozzle head, moves down step by step, and an external air input is disconnected, and only the air that is in the air chamber is inputted into an air and liquid mixing chamber. When the nozzle head moves up or stops, the air input path keeps closed all the time, so that it is possible to basically prevent the liquid in the air and liquid mixing chamber from flowing in a reverse direction into the air chamber while overcoming the problems encountered in the previous conventional art. In addition, a ball valve support, which operates depending on a move up and down operation of a valve shaft, is provided at the lower end of a valve shaft, so that an opening and closing operation of the ball valve is performed smoothly.

To achieve the above object, there is provided a foam pump dispenser having a leakage prevention function against a reverse flow which comprises an air valve member which is engaged at a lower side of the air and liquid mixing chamber of the piston cover member; a liquid leakage prevention spring which is disposed between the piston cover member and the piston member; and a liquid leakage prevention valve which is covered on the upper side of the liquid compression piston.

BRIEF DESCRIPTION OF THE DRAWINGS

The present invention will become better understood with reference to the accompanying drawings which are given only by way of illustration and thus are not limitative of the present invention, wherein;

FIGS. 5A through 5D are enlarged cross sectional views illustrating the operation states of a pump dispenser, namely, the operation states of a content opening and closing valve part and an air opening and closing valve member when the nozzle head is fully moved up according to the present invention, of which:

FIG. 5A is a view illustrating a state that a valve shaft is closed;

FIG. 5B is a view illustrating a state that an external air is being inputted into an air chamber as an air opening and closing passage opens;

FIG. 5C is a view illustrating a state that an air opening and closing plate of an air valve member is closed; and FIG. 5D is a view illustrating a state that a ball valve is closed; and FIGS. 6A through 6D are partially enlarged cross sectional views illustrating the operation state of a pump dispenser, namely, the operation states of a valve shaft and an air valve member when a nozzle head is moved down according to the present invention, of which:

FIG. 6A is a view illustrating a state that a valve shaft is open;

FIG. 6B is a view illustrating a state that an input of an external air into an air chamber is disconnected as an air opening and closing passage is closed;

FIG. 6C is a view illustrating a state that an air opening and closing plate of an air valve member is open; and FIG. 6D is a view illustrating a state that a ball valve presses a ball valve support; and FIGS. 7A through 7F are enlarged cross sectional views illustrating the operation states of a ball valve support which is an important element of a pump dispenser according to the present invention, of which:

FIG. 7A is a view illustrating a state that a ball valve support is moved up;

FIG. 7B is a view illustrating a state that a lower end of a ball valve support slightly presses a ball valve based on a first move down of a valve shaft;

FIG. 7C is a view illustrating a state that a valve shaft keeps moving down;

FIG. 7D is a view illustrating a state that a valve shaft is fully moved down, and then a ball valve support keeps pressing a ball valve;

FIG. 7E is a view illustrating a state that a valve shaft moves up; and

FIG. 7F is a cross sectional view illustrating a state that a valve shaft is fully moved up.

MODES FOR CARRYING OUT THE INVENTION

Figure 1:
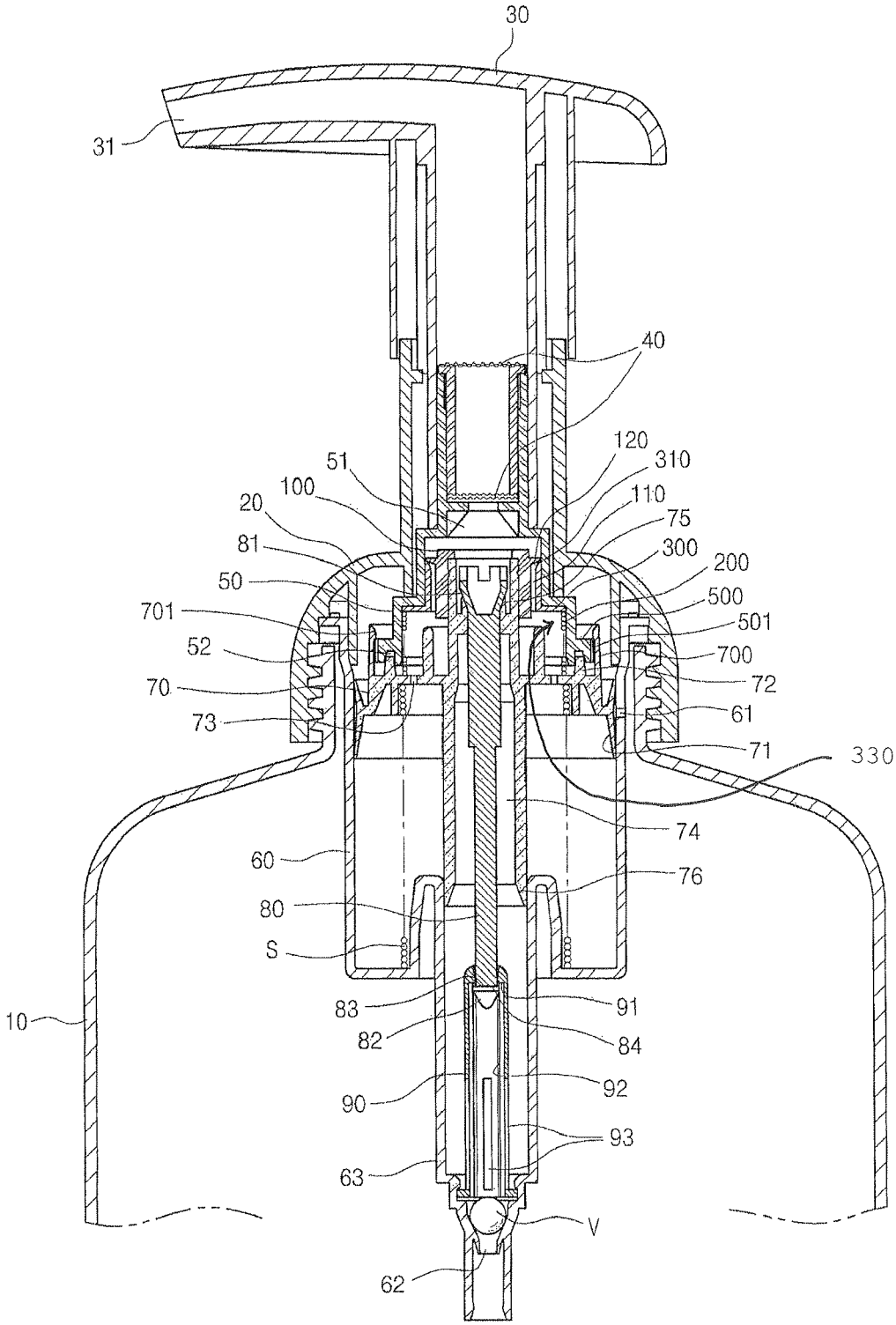
FIG. 1 is a cross sectional view illustrating a state that a nozzle head of a pump dispenser is fully moved up according to the present invention.

The preferred embodiment of the present invention will be described with reference to the accompanying drawings.

In a foam discharge pump dispenser which includes a liquid storing container 10 in which a cap 20 is covered on an upper side of the same, a nozzle head 30 which is assembled to move up and down on an upper side of the cap 20 and has a foam discharge hole 31, a foam filtering mesh 40 which is engaged in the interior of the nozzle head 30, a piston cover member 50 which is fixed at a lower side of the nozzle head 30 and has an air and liquid mixing chamber 51 at an upper side of the same and an air opening and closing passage 52 formed at a lower surface of the same, an air chamber 60 which is engaged in the interior of the liquid storing container 10 and has an air inlet hole 61 formed at a side surface and a liquid cylinder 63 having a liquid inlet port 62 at a lower side, a piston member 70 which is engaged in the interior of the air chamber 60 and integrally includes an air compression piston 71 at an outer side, an air opening and closing step 72 and an air flow hole 73 at an inner side, a liquid flow path 74 at a center portion, a liquid opening and closing surface 75 at an upper inner surface, and a liquid compression piston 76 at a lower side of the same, a valve shaft 80 which is engaged in the interior of the liquid flow path 74 and has a valve support escape prevention enlargement part 82 formed of a liquid opening and closing enlargement part 81 at an upper end and a ball valve support engaging shoulder 83 at a lower end, a ball valve support 90 disposed at a lower end of the valve shaft 80, a ball valve v disposed between the ball valve support 90 and the liquid inlet port 62, and a return springs disposed between the piston member 70 and the air chamber 60, there is provided a foam pump dispenser having a leakage prevention function against a reverse flow which comprises an air valve member 100 which is engaged at a lower side of the air and liquid mixing chamber 51 of the piston cover member 50 and is fixedly covered on an upper side of the piston member 70; an air valve guide member 300 which is fixedly inserted into an intermediate inner surface of the piston cover member 50; and a liquid leakage prevention valve 300 in which the liquid leakage prevention spring 200 disposed between the piston cover member 50 and the piston member 70 is covered on an upper side of the liquid compression piston 76.

An air passage 110 is provided between an outer wall of the air valve member 100 and an inner wall of the air valve guide member 300, and an air opening and closing plate 120 is provided in an upper side of an outer wall of the air valve member 100. The thickness of the air opening and closing plate 120 is getting thinner in a direction of an outer side with a bottom side being upwardly slanted. The air valve guide member 300 comprises an air opening and closing step 310 of which an upper surface contacts with a lower surface of the air opening and closing plate 120. A friction surface 84 is formed on a wall of the ball valve support escape prevention enlargement part 82 of the valve shaft 80.

The ball valve support 90 comprises a valve shaft escape prevention shoulder 91 by which the ball valve support engaging shoulder enlargement part 82 of the valve shaft 80 is engaged at an upper inner side, a plurality of vertical friction ribs 92 which contact with the friction surface 84 formed at the wall of the ball valve support escape prevention enlargement part 82 of the valve shaft 80, and a plurality of liquid discharge ports 93 which are formed at the wall of the ball valve support 90.

The piston member escape prevention surface 500 is provided with a plurality of external air inlet grooves 501 at the wall, and the piston member escape prevention holder 700 is provided with an escape prevention step 701 of the piston member 70 at an inner upper side.

The return spring s is disposed at a lower side of the air compression piston 71 in the air chamber for avoiding a contact with the liquid.

The operation and effects of the present invention will be described.

FIG. 1 is a cross sectional view illustrating a state that a nozzle head of a pump dispenser is fully moved up according to the present invention. As shown therein, in the above state, the air compression piston 71 of the air chamber 60 is fully moved up, and the air compression piston 71 closes the air inlet hole 61 of the liquid storing container 10 formed at the air chamber 60. When the air compression piston 71 moves up, the air is inputted from the outside of the pump into the air chamber 60 via the air flow hole 73 formed at the air compression piston 71. The bottom surface of the leakage liquid block plate formed on an outer surface of the air valve member 100, which is closer to the air opening and closing step 310 provided in the upper side of the air valve guide member 300, closes the air passage 110 formed between the outer wall of the air valve member 100 and the inner wall of the air valve guide member 300, and a certain space is formed between the air opening and closing passage 52 and the air opening and closing step 72 with the help of an elastic force of the leakage liquid prevention spring 200 disposed between the piston cover member 50 and the piston member 70. In this state, an external air is inputted into the air chamber 60 through the external air inlet groove 501 formed on the wall of the piston member escape prevention surface 500 of the piston cover member 50. The ball valve v of the lower side of the liquid cylinder 63 closes the liquid inlet port 62 of the lower side of the liquid cylinder 63 with the helps of a self-weight.

In addition, in a state that the nozzle head 30 remains in a raised state, the upper side of the piston member escape prevention surface 500 provided in the lower side of the piston cover member 50 is supported by means of the piston member escape prevention step 701 of the piston member escape prevention surface holder 700. As the nozzle head 30 moves down, when the piston cover member 50 is lowered, the air opening and closing passage 52 formed in the lower surface of the piston cover member 50 contacts closer to the air opening and closing step 72 formed in the piston member 70, so that an external air input is blocked.

Figure 2:
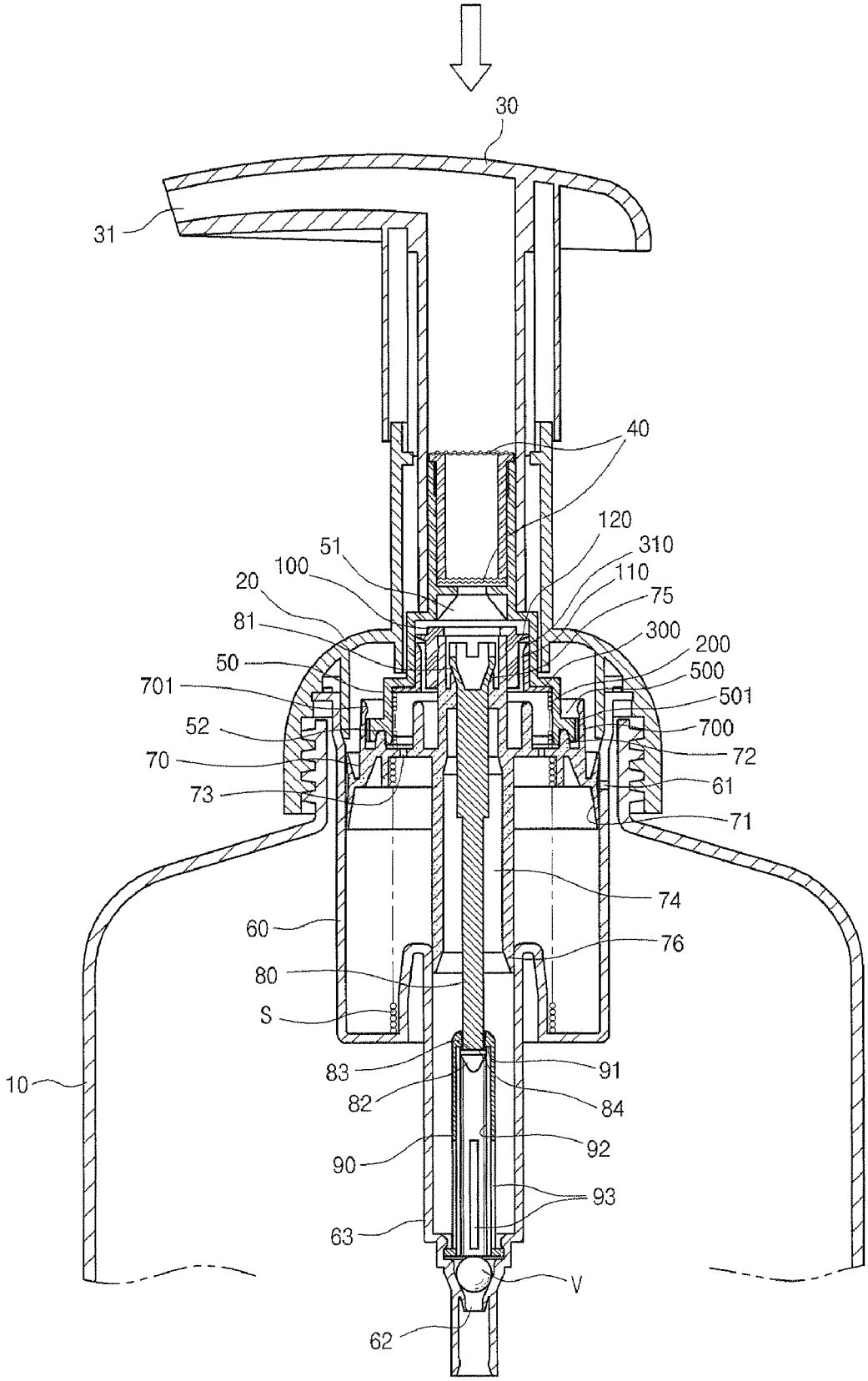
FIG. 2 is a cross sectional view illustrating a state that a nozzle head of a pump dispenser is moved down by one step according to the present invention.
Figure 6:
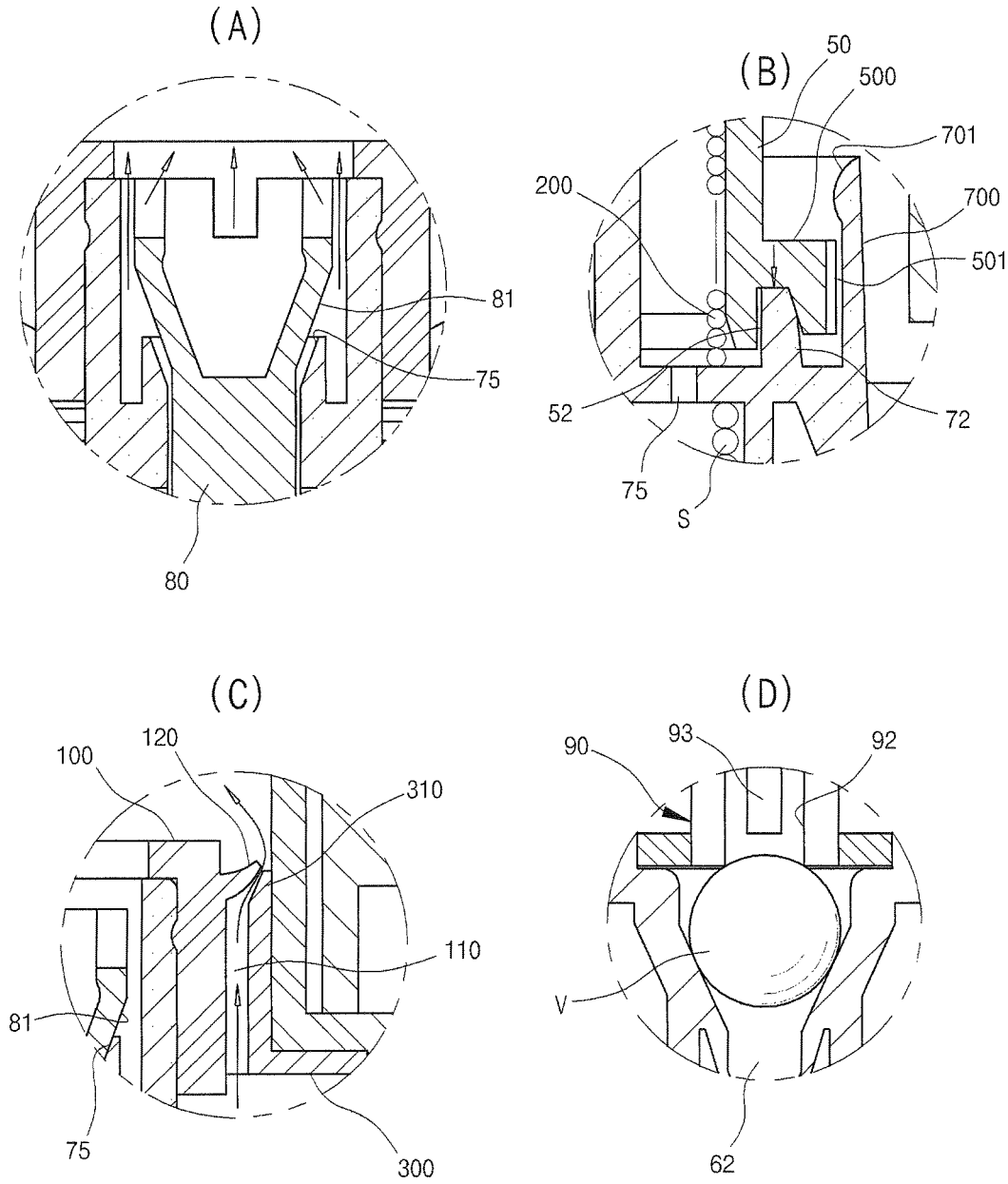
Figure 7:
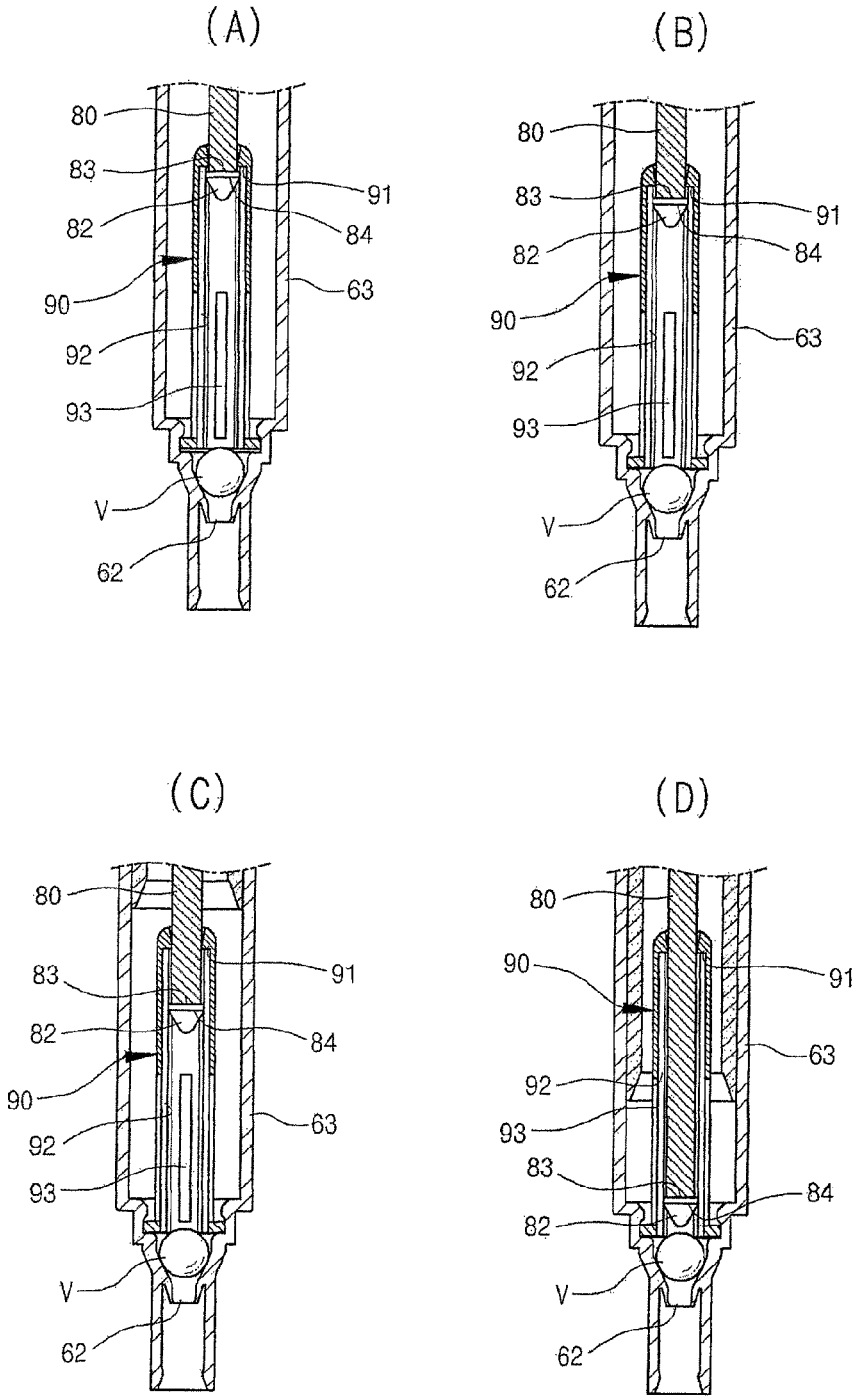
Figure 7:
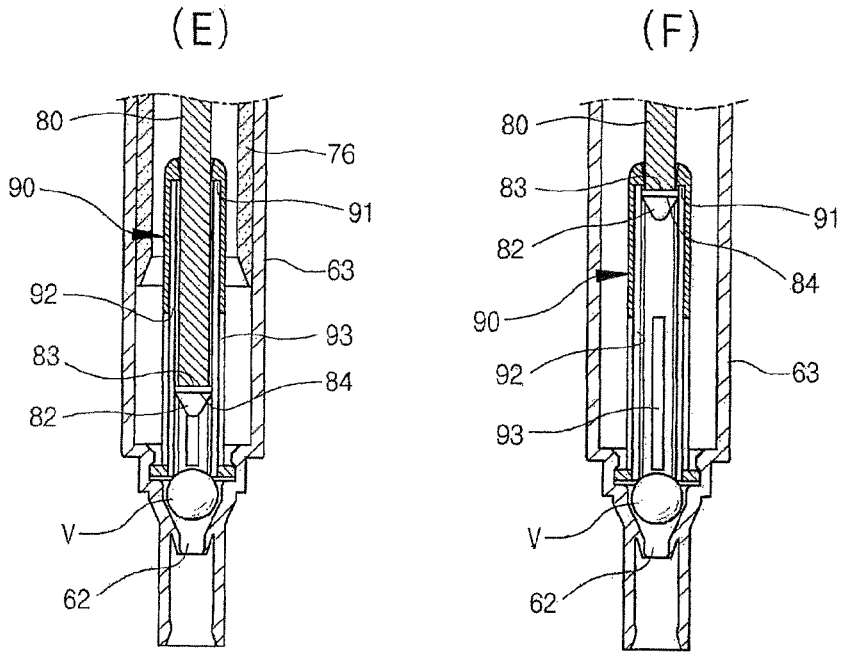
Figure 8:
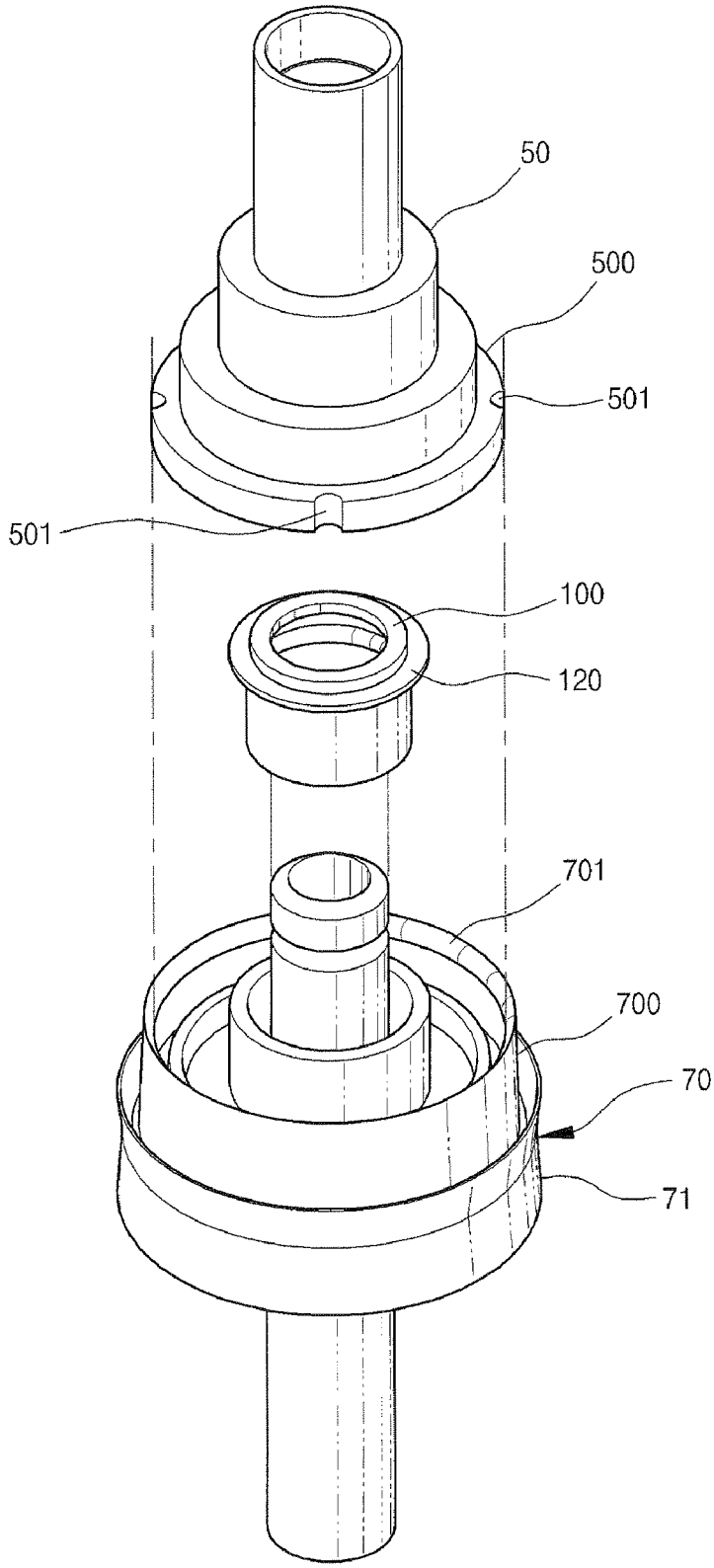
FIG. 8 is a disassembled perspective view illustrating a piston cover member, an air opening and closing member and a piston member of an air guide and leakage liquid prevention valve which are parts of a pump dispenser according to the present invention.
Figure 9:
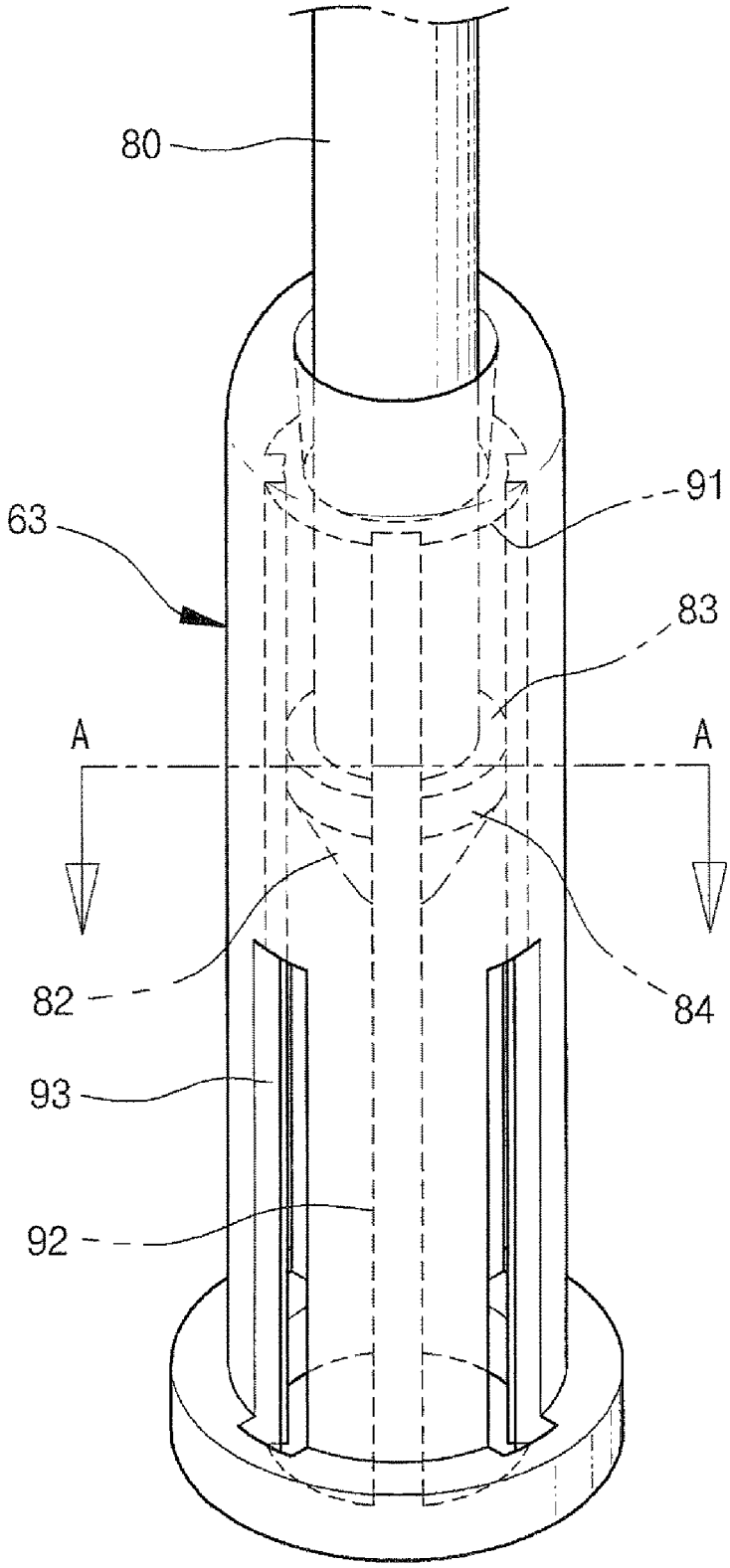
FIG. 9 is a perspective view illustrating an assembled state of a ball valve support and a valve shaft which are important elements of a pump dispenser according to the present invention.
Figure 10:
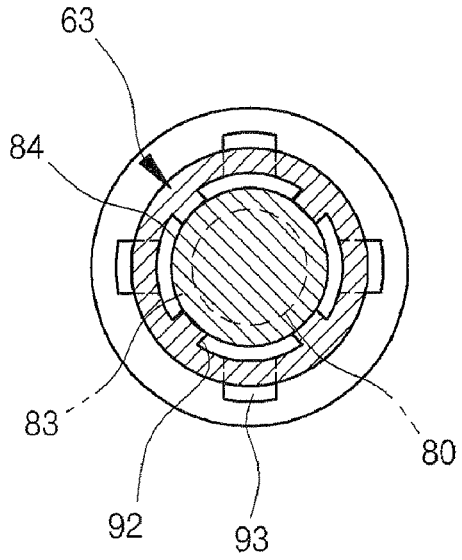
FIG. 10 is a cross sectional view taken along line A-A of FIG. 9.

In the state of FIG. 1, so as to discharge the foam, the nozzle head 30 is pressed as shown in FIG. 2, and the piston cover member 50 moves down and pressurizes the liquid leakage prevention spring 200, so that the first stage operation is performed as shown in FIG. 2. When the piston cover member 50 moves down, the valve shaft 80 moves down along with the same. The ball valve support 90 moves down by a friction force between the friction surface 84 provided at the ball valve support escape prevention enlargement part 82 formed at a lower side of the valve shaft 80 and the vertical friction rib 92 formed at an inner surface of the ball valve support 90, and a lower end of the vertical friction rib 92 presses the ball valve v, so that the ball valve v stably closes the liquid inlet port 62. In the first move down operation, only the piston cover member 50 moves down in a state that the liquid leakage prevention spring 200 is contracted as the piston member 70 is not moved down by means of a friction pressure between the air compression piston 71 of the piston member 70 and an inner surface of the air chamber 60. As the opening and closing passage 52 formed in the bottom surface of the piston cover member 50 prevents the air of the air chamber 60 from being discharged to the outside as it contacts closely to the air opening and closing step 72 formed in the flat portion of the piston member 70. At this time, the air valve member 100 inserted on the upper side of the member 70 moves down along with the piston cover member 50, and the air opening and closing plate 120, which is provided on an outer wall of the air valve member 100 and blocks the air passage 110, is bent by means of the air pressure as shown in FIG. 6C, so that the air passage 110 is opened. In this state, when the nozzle head 30 is pressed, the piston cover member 50 moves down, and the air of the air chamber 60 is inputted into the air flow hole 73 by means of the pressure of the air compression piston 71. In a state that the air opening and closing plate 120 is open, the air is inputted into the air and liquid mixing chamber 51 through the air passage 110. As a certain space is formed between the liquid opening and closing surface 75 formed on the upper inner surface of the liquid compression piston 71 and the liquid opening and closing enlargement part 81 of the liquid valve shaft 80, the liquid of the liquid cylinder 63 passes through between the liquid opening and closing surface 75 and the liquid opening and closing enlargement part 81 and is inputted into the air and liquid mixing chamber 52, so that the liquid is mixed with the air.

At this time, as the piston cover member 50 moves down, and the air opening and closing passage 52 and the air opening and closing step 72 are closely contacted with each other, so that an external air does not input into the air chamber 60.

Figure 3:
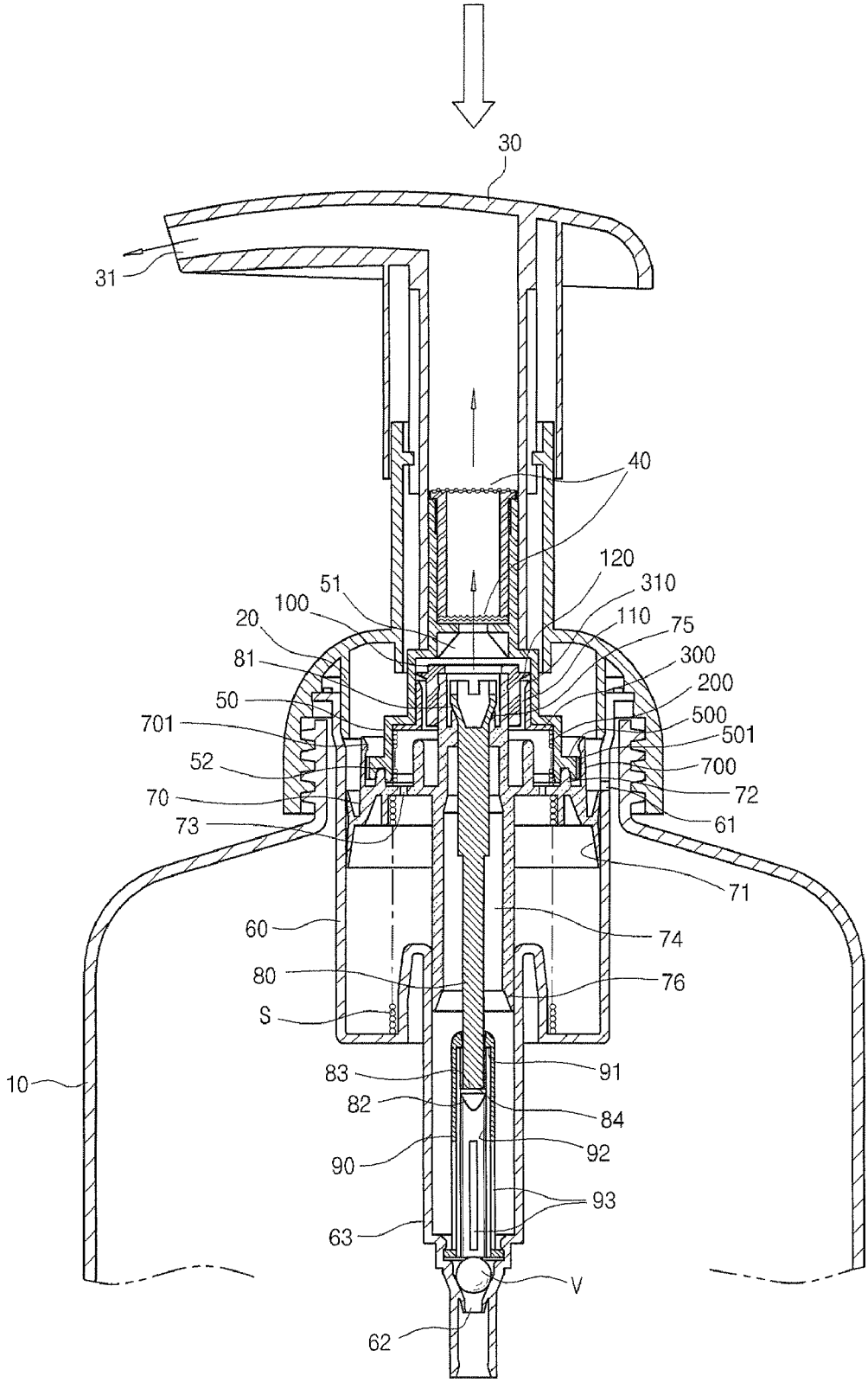
FIG. 3 is a cross sectional view illustrating a state that foams are generated as a nozzle head of a pump dispenser is moved down by one step and then is continuously moved down according to the present invention.

As the nozzle head 30 keeps moving down, the air and liquid are inputted into the air and liquid mixing chamber 51 and are mixed therein and change to foam states and pass through the foam filtering mesh 40 and are discharged via the foam discharge hole 31 of the nozzle head 30 as shown in FIG. 3. When the valve shaft 80 moves down, the liquid in the interior of the ball valve support 90 are fast discharged into the liquid cylinder via the liquid outlet port 93 formed at a wall of the ball valve support 90.

Figure 4:
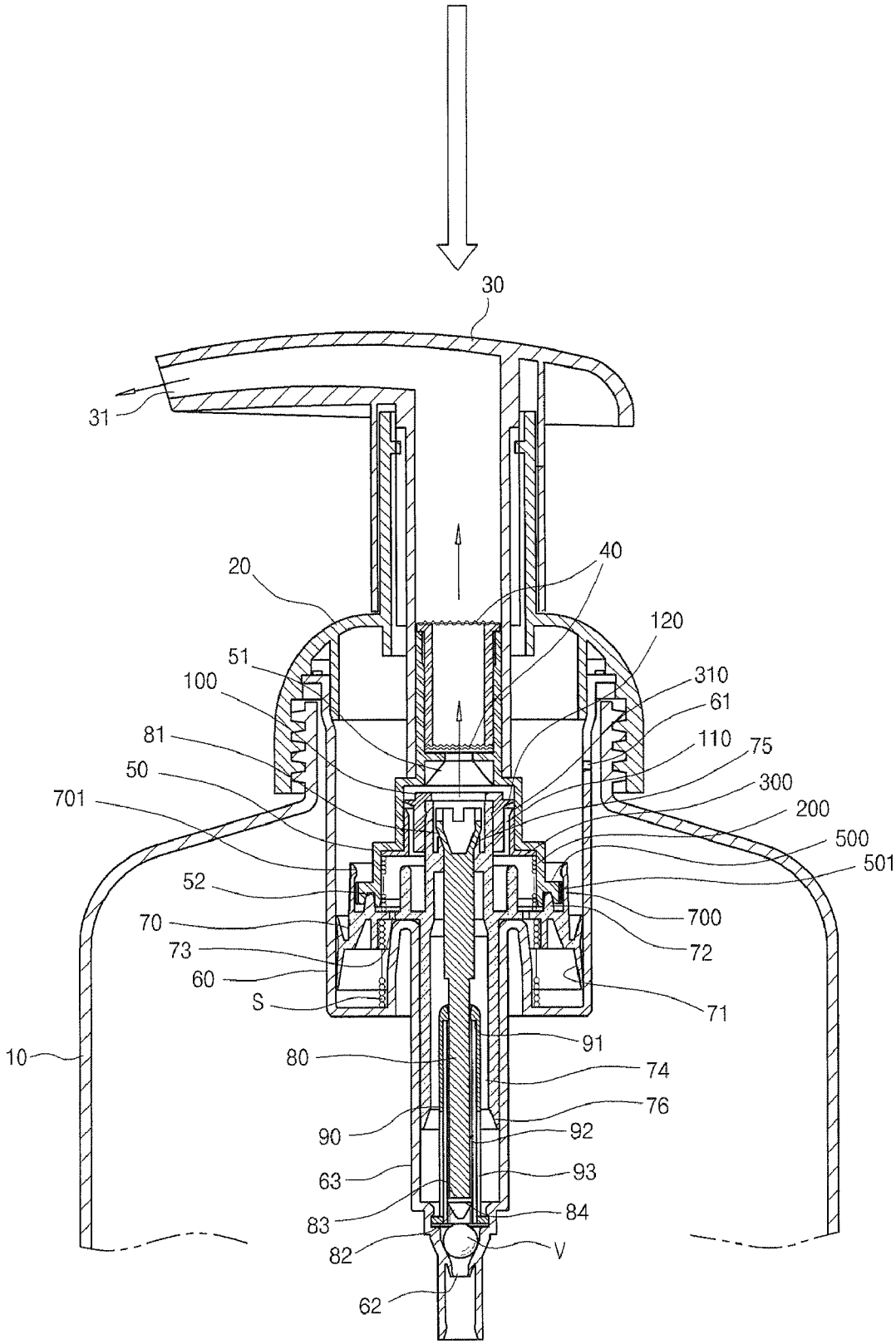
FIG. 4 is a cross sectional view illustrating a state that a nozzle head of a pump dispenser is fully moved down according to the present invention.
Figure 5:
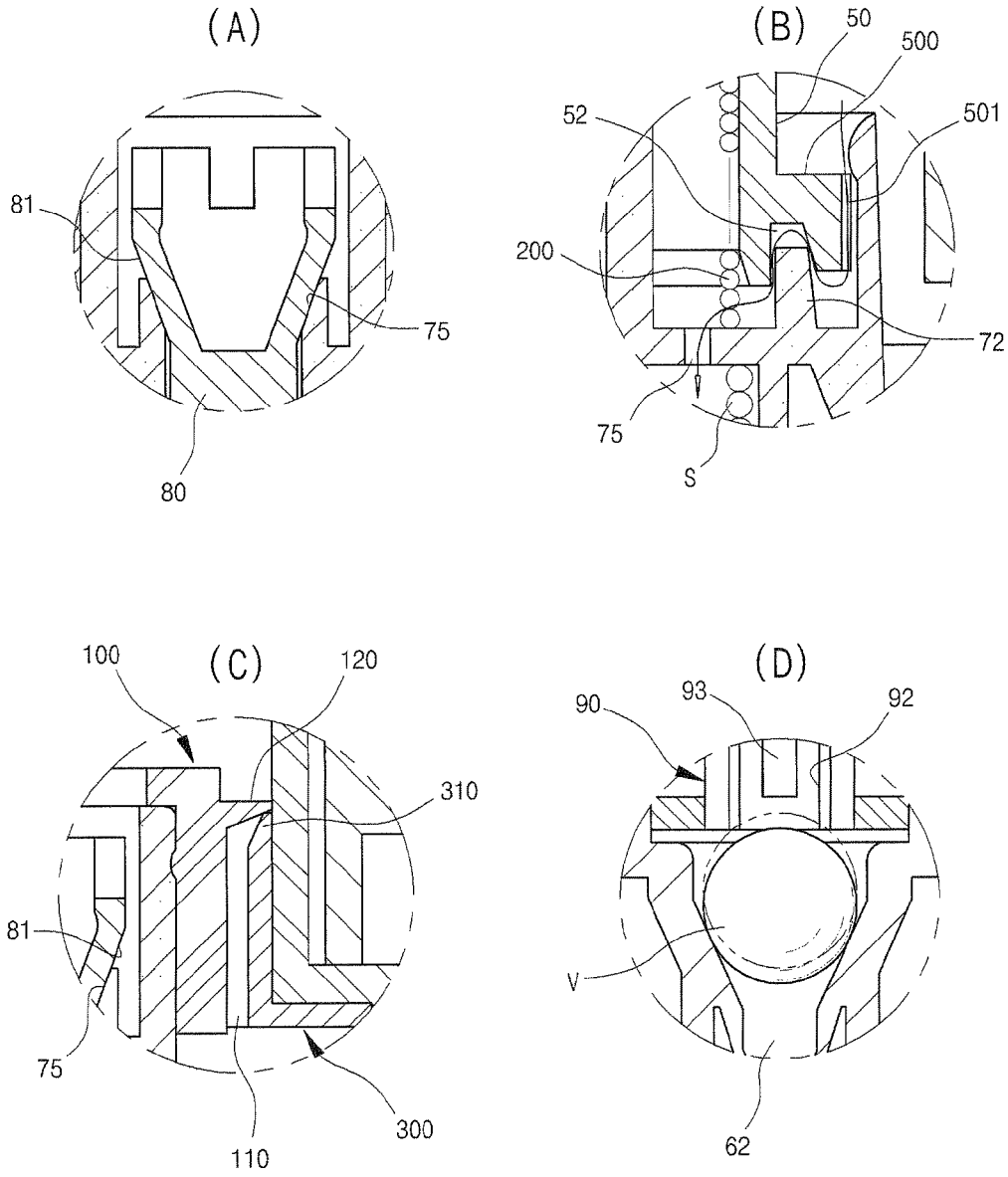

As shown in FIG. 4, the nozzle head 30 is fully moved down. As the lower end of the vertical friction rib 92 of the ball valve support 90 presses the ball valve v, which blocks the input of the liquid into the liquid storing container 10 by the pressure and weight of the liquid compression piston 76, it is possible to fully prevent the input of liquid. The lower end of the vertical friction rib 92, which is provided at multiple portions at regular intervals, respectively, presses the ball valve v, so that it is possible to stably press the ball valve v based on a pressure distribution by a plurality of vertical friction ribs 92, and the gaps formed between the vertical friction ribs 92 allow the liquid near the ball valve v not to gather. Namely, the liquid is discharged.

According the liquid leakage prevention structure according to the present invention, the air opening and closing plate 120 of the air valve member 100 covered on the upper side of the member 70 completely closes the air passage 110, and the liquid leakage prevention function is basically performed by means of the liquid leakage prevention spring 200. In a state that the nozzle head 30 is fully moved up, the elastic force of the liquid leakage prevention spring 200 allows the piston cover member 50 to move up. The lower outer side of the air opening and closing plate 120 belonging to the air valve member 100 is closely contacted with the air opening and closing step 310 of the air valve guide member 300, so that it is possible to prevent the liquid of the air and liquid mixing chamber 51 from being reverse-flowing into the interior of the air chamber 60.

In addition, the lower surface of the air opening and closing plate 120 belonging to the air valve member 100 is supported by means of the air opening and closing step 310 formed on the upper side of the air valve guide member 300. So, the air opening and closing plate 120 is not pushed downward by means of the pressure of the stuff, so that the sealing performance is largely enhanced, and an excellent liquid leakage prevention effect is obtained.

The upper surface of the air opening and closing plate 120 maintains a horizontal state, and the lower surface of the same is oriented outwards at a certain slanted angle. The thickness of the air opening and closing plate 120 is getting thinner in the outward direction, so when the piston cover member 50 moves down, the air opening and closing plate 120 is not bent while keeping its original state, so the leakage phenomenon is prevented for thereby obtaining an excellent closing function. When the piston cover member 50 moves up, the air opening and closing plate 120 is easily bent upward by means of a friction force with the inner wall of the air valve guide member 300 as shown in FIG. 6C. So, the lower surface of the air opening and closing plate 120 is getting thinner in an outward direction.

Since the piston member escape prevention surface 500 of the piston cover member 50 is supported by means of the piston member escape prevention step 701 formed on the inner upper side of the piston member escape prevention surface holder 700, the piston member 70 does not easily escape even when the piston cover member 50 and the piston member 70 repeatedly reciprocate.

In the present invention, since the return spring s, which is used for moving up the nozzle head 30, is engaged at the lower side of the air compression piston 71 in the air chamber 60, a direction contact with the liquid can be prevented, so that a certain change of the liquid owing to the corrosion of the return spring s can be basically prevented.

In the present invention, the air valve member 100 is preferably made of a rubber material which has an excellent elastic function for effectively preventing the reverse flow of the liquid.

As described above, in the present invention, the liquid leakage prevention spring is provided between the air valve member covered on the upper side of the piston member and the air valve guide member formed in the inner side of the intermediate portion of the piston cover member, and between the piston cover member and the piston member, respectively, and the ball valve support is provided at the lower side of the valve shaft.

When the nozzle head is pressed so as to discharge the foam, the nozzle head moves down one step, so that an external air is prevented from being inputted into the air chamber, and only the air in the air chamber is inputted into the air and liquid mixing chamber. So, in a state that a foam discharge is completed, and the nozzle head is fully moved up, since the liquid of the air and liquid mixing chamber is not inputted into the air chamber, the air volume of the interior of the air chamber keeps a fixed volume, so that the amount of air mixed with the liquid is constant, and the foam is uniform. The air compression piston in the air chamber operates smoothly, and the opening and closing operations of the ball valve is smooth by means of the ball valve support.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a foam discharge pump dispenser which includes a liquid storing container 10 in which a cap 20 is covered on an upper side of the same, a nozzle head 30 which is assembled to move up and down on an upper side of the cap 20 and has a foam discharge hole 31, a foam filtering mesh 40 which is engaged in the interior of the nozzle head 30, a piston cover member 50 which is fixed at a lower side of the nozzle head 30 and has an air and liquid mixing chamber 51 at an upper side of the same and an air opening and closing passage 52 formed at a lower surface of the same, an air chamber 60 which is engaged in the interior of the liquid storing container 10 and has an air inlet hole 61 formed at a side surface and a liquid cylinder 63 having a liquid inlet port 62 at a lower side, a piston member 70 which is engaged in the interior of the air chamber 60 and integrally includes an air compression piston 71 at an outer side, an air opening and closing step 72 and an air flow hole 73 at an inner side, a liquid flow path 74 at a center portion, a liquid opening and closing surface 75 at an upper inner surface, and a liquid compression piston 76 at a lower side of the same, a valve shaft 80 which is engaged in the interior of the liquid flow path 74 and has a valve support escape prevention enlargement part 82 formed of a liquid opening and closing enlargement part 81 at an upper end and a ball valve support engaging shoulder 83 at a lower end, a ball valve support 90 disposed at a lower end of the valve shaft 80, a ball valve v disposed between the ball valve support 90 and the liquid inlet port 62, and a return spring s disposed between the piston member 70 and the air chamber 60, a foam pump dispenser having a leakage prevention function against a reverse flow, comprising:

an air valve member 100 which is engaged at a lower side of the air and liquid mixing chamber 51 of the piston cover member 50 and is fixedly covered on an upper side of the piston member 70;

an air opening and closing plate 120 provided on an upper side of an outer wall of the air valve member 100;

an air valve guide member 300 which is fixedly inserted into an intermediate inner surface of the piston cover member 50; and a liquid leakage prevention valve 330 comprising the air valve guide member 300 and a liquid leakage prevention spring 200 disposed between the piston cover member 50 and the piston member 70, wherein the liquid leakage prevention member 300 is covered on an upper side of the liquid compression piston 76.

2. The dispenser of claim 1, wherein an air passage 110 is provided between an outer wall of the air valve member 100 and an inner wall of the air valve guide member 300.

3. The dispenser of claim 1, wherein an upper surface of the air opening and closing plate 120 has a plane shape, and a lower surface of the same is slanted in an outward direction.

4. The dispenser of claim 1, wherein the thickness of the air opening and closing plate 120 is getting thinner in an outward direction.

5. The dispenser of claim 1, wherein said air valve guide member 300 is provided with an air opening and closing step 310 at its upper side.

6. The dispenser of claim 1, wherein an external air is inputted or blocked by repeatedly opening and closing the air opening and closing passage 52 formed in the air opening and closing step 72 of the air compression piston 71 and the lower surface of the piston member 70.

7. The dispenser of claim 1, wherein a piston member escape prevention surface 500 having a plurality of air inlet grooves 501 at its wall surface is provided in the lower side of the piston cover member 50.

8. The dispenser of claim 1, wherein a piston member escape prevention surface holder 700 having a piston member escape prevention step 701 is provided on an inner upper surface of the piston member 70.

9. The dispenser of claim 1, wherein a friction surface 84 is formed on a wall surface of the ball valve support escape prevention enlargement part 82.

10. The dispenser of claim 1, wherein said ball valve support 90 includes a valve shaft escape prevention step 91 on an upper inner surface for engaging the ball valve support engaging step enlargement part 82 of the valve shaft 80, a plurality of vertical friction ribs 92 which are closely contacted with the friction surface 84 formed on a wall surface of the ball valve support escape prevention enlargement part 82 of the valve shaft 80, and a plurality of liquid discharge ports 93 formed on the wall surface of the ball valve support 90.

11. The dispenser of claim 1, wherein a return spring s is engaged at a lower side of the air compression piston 71 in the air chamber for avoiding a direct contact with the liquid.

* * * * *